US005644345A

United States Patent [19]

Toniolo

[11] Patent Number: 5,644,345

[45] Date of Patent: Jul. 1, 1997

[54] SERVICE STATION FOR INK JET PRINTER

[75] Inventor: Antonio Toniolo, Aglie', Italy

[73] Assignee: Olivetti-Canon Industriale S.p.A., Ivrea, Italy

[21] Appl. No.: 329,164

[22] Filed: Oct. 26, 1994

[30] Foreign Application Priority Data

Nov. 11, 1993 [IT] Italy ..... TO93A0854

[51] Int. Cl.[6] ..... B41J 2/165

[52] U.S. Cl. ..... 347/32; 347/33

[58] Field of Search ..... 347/32, 29, 30, 347/33

[56] References Cited

U.S. PATENT DOCUMENTS

| | | | |
|---|---|---|---|
| 5,097,276 | 3/1992 | Midorikawa | 347/33 |
| 5,103,244 | 4/1992 | Gast et al. | 346/1.1 |
| 5,155,497 | 10/1992 | Martin et al. | 346/1.1 |
| 5,394,178 | 2/1995 | Grange | 347/32 |
| 5,563,637 | 10/1996 | Francis et al. | 347/32 |

FOREIGN PATENT DOCUMENTS

| | | |
|---|---|---|
| 410691 | 1/1991 | European Pat. Off. . |
| 465260 | 1/1992 | European Pat. Off. . |

*Primary Examiner*—John E. Barlow, Jr.
*Attorney, Agent, or Firm*—Banner & Witcoff, Ltd.

[57] ABSTRACT

In a station for cleaning, restoring and protecting the nozzles of an ink jet printer, a cleaning blade is connected to the nozzle restoring and protecting device and controlled by it when moved by the motion of the print head into its operating position. The restoring and protecting device comprises two covers that are selectively coupled to one or the other of two heads for printing in black or in color, respectively. The restoring and protecting device sets the cleaning blade in the best position for cleaning the two heads, by means of a rocker. The service station is of a simple construction and uses a small number of component parts.

9 Claims, 5 Drawing Sheets

SERVICE STATION FOR INK JET PRINTER

BACKGROUND OF THE INVENTION

The present invention relates to a service station for an ink jet printer.

U.S. Pat. No. 5,155,497 (Martin et al.) discloses a service station which includes a cleaning member which removes residues of ink from the print head, and also includes means for isolating the head from the external environment to maintain it in an efficient condition. The service station uses a support that can be rotated selectively through 180°. This support carries on one side a first cleaning blade and a first elastic cover, and on the opposite side a second blade and a second elastic cover. Depending on what type of head the printer is using, i.e. either a head for printing in black or a head for printing in colors, the support is rotated as required in order selectively to couple the first blade and cover or the second blade and cover, to one or the other head.

This service station is therefore of complex construction in view of the large number of component parts, and is very space-hungry, especially if it is to be fitted to a small printer.

SUMMARY OF THE INVENTION

An object of the present invention is therefore to provide a service station of simple construction that takes up relatively little space.

The invention is defined in the independent claims below, to which reference should now be made. Advantageous features of the invention are set forth in the appendant claims.

A preferred embodiment is described in more detail below, in which an ink jet printer has a station for cleaning, restoring and protecting the nozzles of the print head. A cleaning blade is coupled to the nozzle restoring and protecting device and is controlled by it when moved, by the motion of the print head, into its operating position. The restoring and protecting device comprises two covers, or caps, that can be selectively coupled to one or the other of two heads for printing in black or in color respectively. The restoring and protecting device sets the cleaning blade in the best position for cleaning the two heads, by means of a rocker. The preferred service station is of relatively simple construction and uses only a small number of component parts.

BRIEF DESCRIPTION OF THE DRAWINGS

The invention will be described in more detail, by way of example, with reference to the accompanying drawings, in which.

DETAILED DESCRIPTION OF THE PREFERRED EMBODIMENT

The Figures illustrate a service station for a printer having an ink jet print head that moves over a printing support and comprises a cleaning member which removes residues of ink from the head, and capping means which isolate this head from the external environment and maintain it in an efficient condition.

Figure 1:
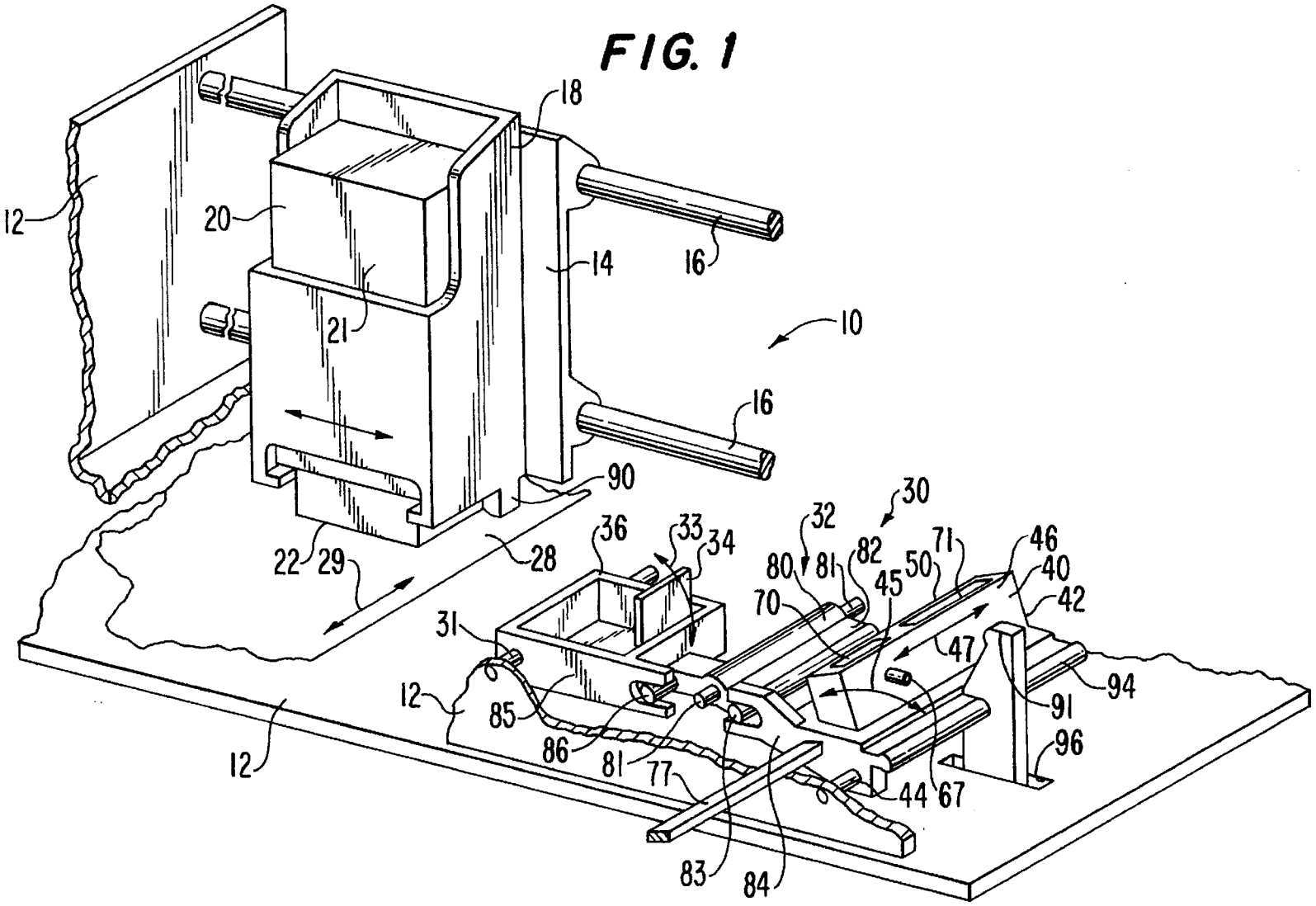
FIG. 1 diagrammatically shows an ink jet printer comprising a service station embodying the invention.

With reference to FIG. 1, the numeral 10 indicates a printer having a frame 12 on which a carriage 14 runs backwards and forwards, guided and supported by two guides 16. The carriage 14 carries a support 18 designed to hold a module 20 for printing in black, but which is interchangeable alternatively with a similar module for color printing.

The module 20 consists of an ink jet print head 22 integral with its own ink reservoir 21.

The module 20 may alternatively be composed of an intermediate support that fits inside the support 18 and carries a print head, and accommodates in turn a removable ink cartridge which connects hydraulically with the head so as to feed it.

The head 22 carries a plate 24 in which nozzles 26 are formed (FIG. 2), from which drops of ink are expelled towards a printing support 28 (FIG. 1) travelling over the frame 12 in the direction 29.

The printer 12 includes a service station 30 for the print head 22. It is positioned on the path of this head, at one end of its travel in a service point 32. The service station 30 comprises a cleaning part 34, and a device 40 for restoring and protecting the nozzles 26. The cleaning part 34 is in the shape of a flexible blade mounted vertically on a trough 36 for collecting the ink removed by the blade 34.

Figure 2:
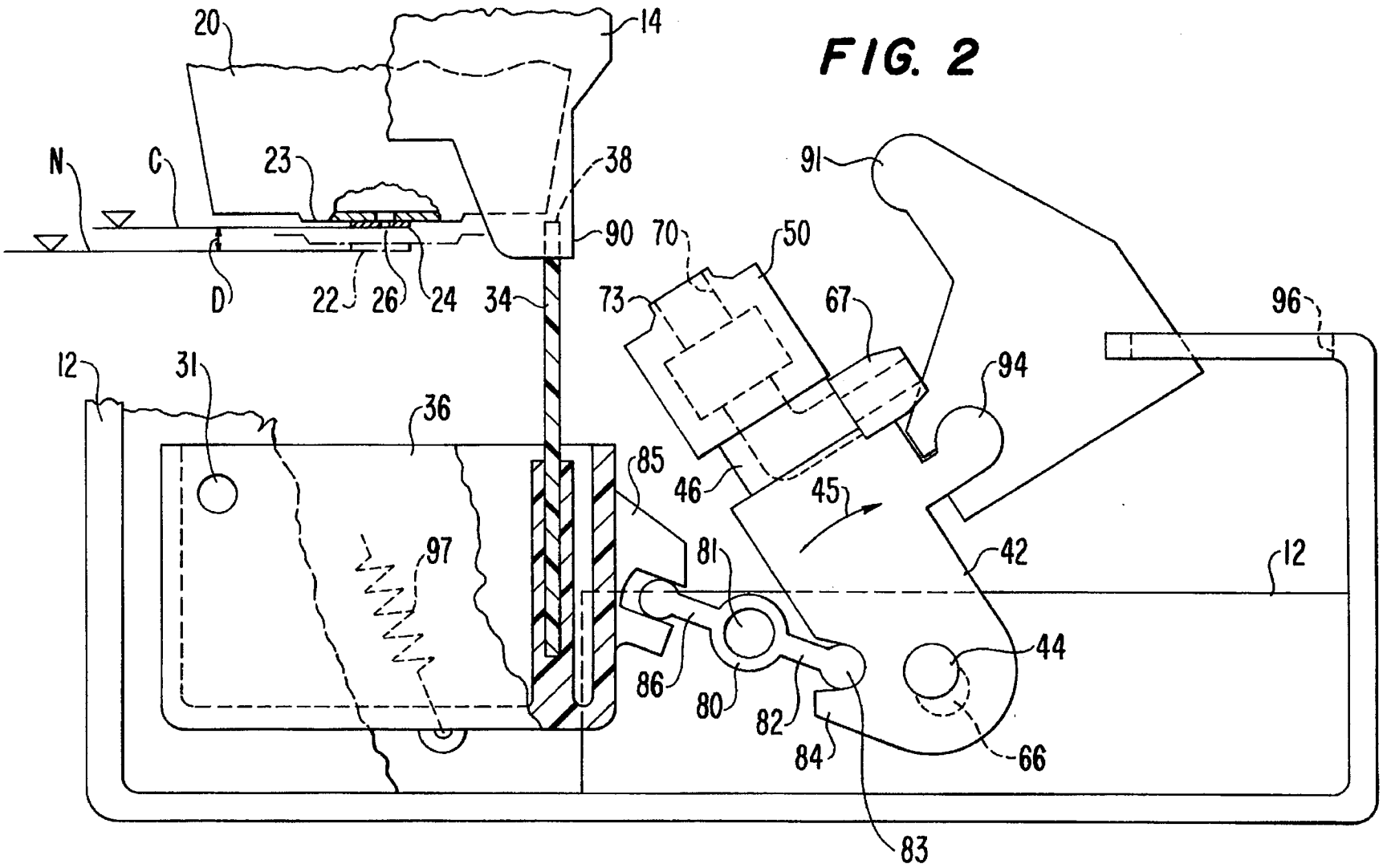
FIG. 2 shows a front view of the service station at rest.

The trough 36 is hinged to the frame 12 by means of a pin 31, on which the trough 36 can pivot as indicated by the arrow 33. The trough is biased upwardly or in an anti-clockwise direction as seen in FIG. 2 by a spring 97, indicated diagrammatically. The blade 34 projects above the trough 36 and is positioned perpendicularly to the path of the head 22. The blade 34 is of a height such that when the trough 36 is in the rest position, shown in FIGS. 1 and 2, the top edge 38 of the blade 34 interferes either with the head 22 for printing in black, or with a head 23 (FIG. 2) for color printing.

Figure 4:
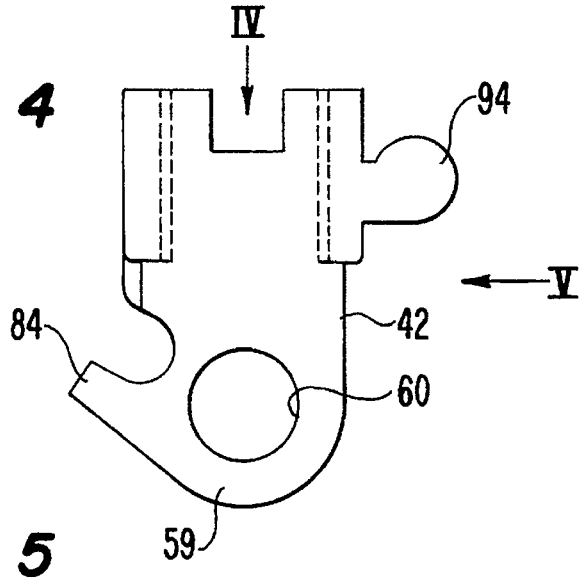
FIGS. 4 to 6 show on an enlarged scale front, side, and plan views respectively of a support of the service station shown in FIG. 2.
Figure 5:
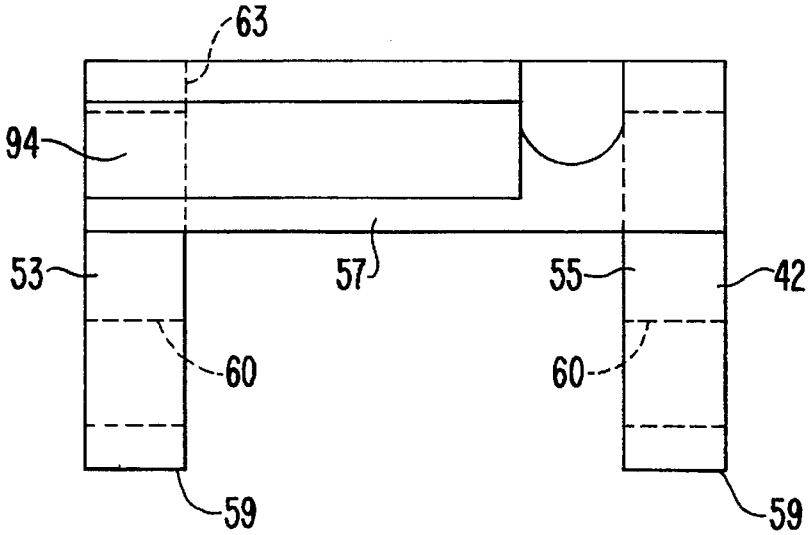
Figure 6:
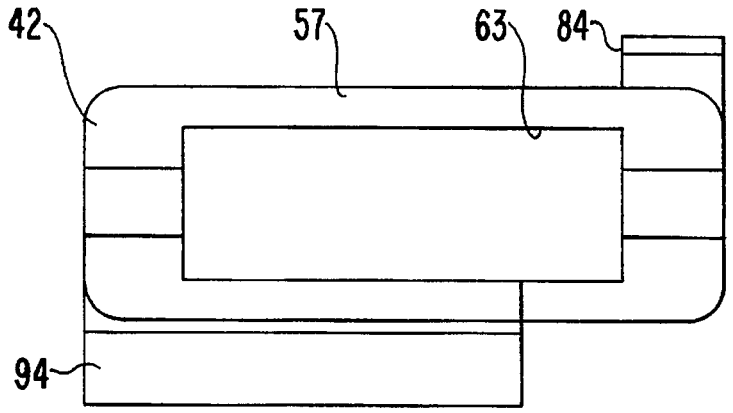

The device 40 for restoring and protecting the nozzles 26 is positioned beyond and in line with the trough 36, in the direction of motion of the carriage 14 towards the position 32. The device 40 comprises a support 42 (FIGS. 4 to 6) capable of independently pivoting and translating axially on a shaft 44 fixed to the frame 12, in the directions of the arrows 45 and 47 respectively (FIG. 1). There are minor differences in the shapes of certain parts shown in the drawings, most notably between FIG. 1 and the other Figures, which illustrates that the device may be made in many different forms embodying the invention.

The support 42 (FIG. 5) includes two arms 53 and 55 parallel with each other and each integral at one end with a cross member 57, while another end 59 of each arm is provided with a hole 60 containing the shaft 44.

Figure 7:
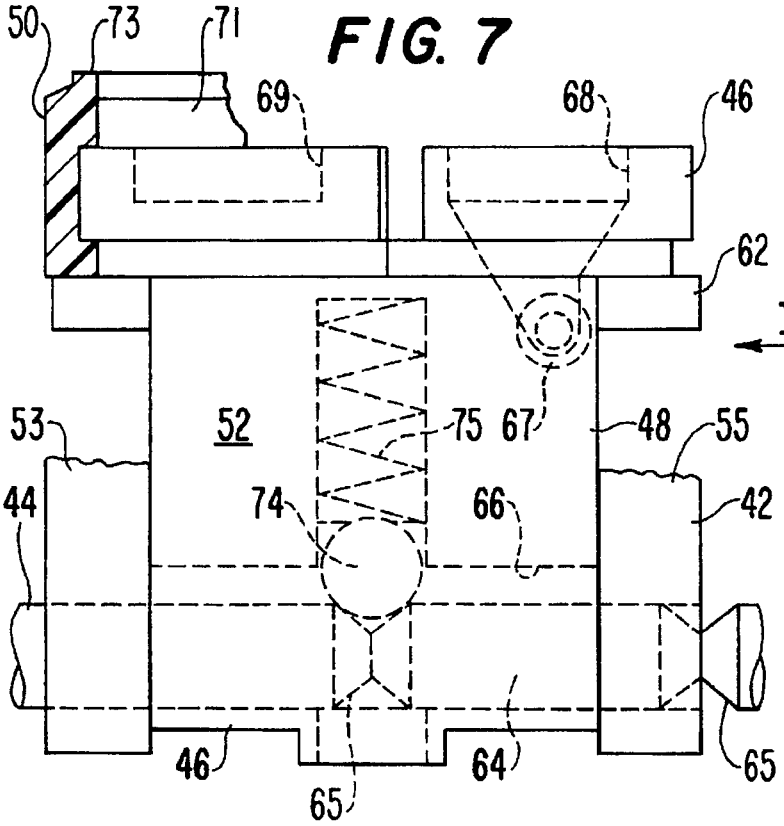
FIG. 7 shows a view of a slide part mounted on the support shown in FIG. 5.
Figure 8:
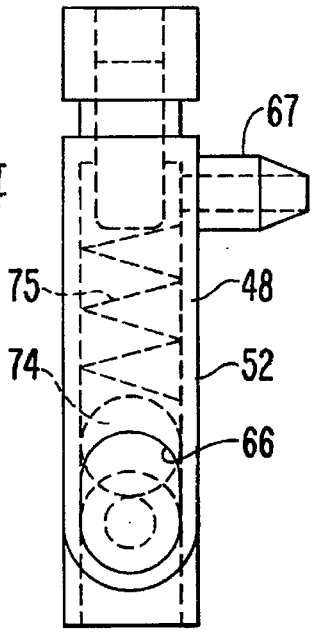
FIG. 8 is a lateral view of the slide part shown in FIG. 7.

Mounted on the support 42 is a part 46 for collecting the ink purged from the nozzles 26. It consists of a slide 48 (FIG. 7) surmounted by a cap or cover 50 of soft rubber to protect the nozzles. The slide 48 is formed by a body 52 of approximately parallelepidal shape that travels between the arms 53 and 55 of the support 42. An upper portion 62 of the body 52 projects above the support 42 through an aperture 63 (FIG. 6) in the cross member 57. A hole 66 containing the shaft 44 passes through the opposite lower portion 64 of the body 52.

The upper portion 62 comprises two recesses 68 and 69 side by side and elongate in the direction of the arrow 47, that is perpendicularly to the path of the heads 22 and 23; these recesses are designed to hold the black ink and the colored ink respectively, as will be explained below. The recess 69 for the colored ink is longer than the recess 68 for the black ink because the color head 23 has a greater transverse dimension than the black head 22.

The recess 69 for the colored ink is closed on the underside, while the recess 68 for the black ink is connected by a tube 67 (FIGS. 1, 2) to a suction device, not shown in the drawings, for aspirating a certain amount of ink from the nozzles of the head 22 in order to avoid possible coagulation of the black ink, which is more likely to coagulate than the colored ink, given its composition.

The cap or cover 50 is fixed elastically to the upper portion 62 of the body 52 and is provided with two apertures 70 and 71 over the recesses 68 and 69 respectively. The apertures 70 and 71 are surrounded by corresponding projecting and elastically yielding edges 73 designed to conform perfectly with the lower face 25 of the head 22, or alternatively of the head 23, when moved into the service point 32.

As has already been indicated earlier, the support 42 and the unit 46 can travel axially along the shaft 44 as a result of a manual action by the operator, from a first position in which the recess 68 and the corresponding aperture 70 in the cap or cover 50 are situated in the path of the head 22 for the black ink, to a second position in which the recess 69 and the corresponding aperture 71 in the cap or cover 50 are situated in the same path when the color head is mounted on the carriage 14.

The printer in fact generates a signal for the operator indicating whether the black head or color head is mounted on the carriage 14.

The positioning of the support 42 in each of the two positions is made stable by means of a compression spring 75 housed inside the body 52 (FIG. 7), and a ball 74 engaging selectively with two grooves 65 on the shaft 44. Movement from one position to the other is brought about by means of a rod 77 (FIG. 1) operated by the operator.

The support 42 (FIG. 2) is connected to the trough 36 by means of a rocker 80 hinged to the frame 12 by pins 81 and having a first arm 82 coupled slidingly with a fork 84 integral with the support 42. A second arm 86 of the rocker 80, situated about 180° away from the first arm 82, pivots in a corresponding fork 85 on the trough 36.

The first arm 82 runs approximately parallel with the longitudinal axis "A" of the rocker 80 in such a way that its edge 83, which forms a guide for the fork 84, is always engaged in the fork as the support 42 is moved in the direction of the arrow 47 (FIG. 1).

If the color head 23 is situated at a level "C" higher than a level "N" of the black head 22, by a predetermined distance "D", as shown in FIG. 2, for example between 0.4 mm and 0.6 mm, it is necessary, in order to ensure correct cleaning action of the blade 34 on both heads, that the top edge 38 of the blade 34 is pressed against both heads with the same force. This is achieved by keeping the interference between the edge 38 of the blade 34 and each of the heads constant.

Figure 9:
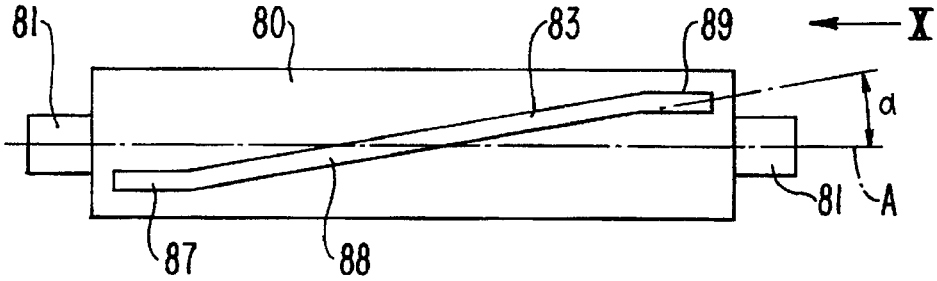
FIG. 9 is a view of a rocker which operates the support shown in FIG. 4.
Figure 10:
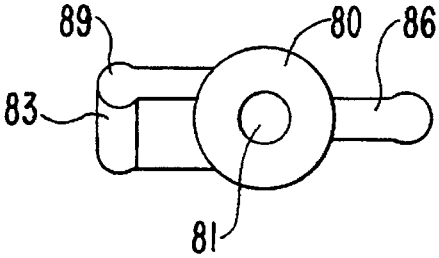
FIG. 10 is an end view of the rocker shown in FIG. 9.

For this purpose the guide 83 of the rocker 80 (FIG. 9) is inclined by an angle "alpha" ($\alpha$) of between approximately 3° and 6° with respect to the axis "A" of the rocker 80. In a preferred embodiment, the guide 83 is subdivided into three portions 87, 88, 89. The endmost portions 87 and 89 run parallel with the axis "A", while the central portion 88, connected continuously with the portions 87 and 89, is inclined at the angle "alpha". In this way the axial movement of the support 42 on the shaft 44 causes a rotation of the rocker 80 and consequently of the trough 36, so that the blade 34 is raised or lowered relative to the levels "C" or "N" of the corresponding heads, thus always being in the best position for the cleaning action.

The rocker 80 with the inclined guide 83 therefore forms a blade setting part, controlled by the axial position assumed by the support 42.

The angle "alpha" can clearly assume values other than those indicated above depending upon the difference between the levels "C" and "N" and upon the dimensions of the components used in embodiments differing from the preferred embodiment described here.

After a certain number of printed lines, the carriage 14 is brought automatically by the printer's logic unit to the service point 32, where, at the end of its travel, a trigger member formed by a tooth 90 on the carriage 14 (FIGS. 1 and 2) moves a lever 91 which is coupled slidingly to a rib 94 on the support 42, causing said support to turn in the direction of the arrow 45. The lever 91 is prevented from moving transversely, but not from pivoting, by a slot 96 in the frame 12.

Figure 3:
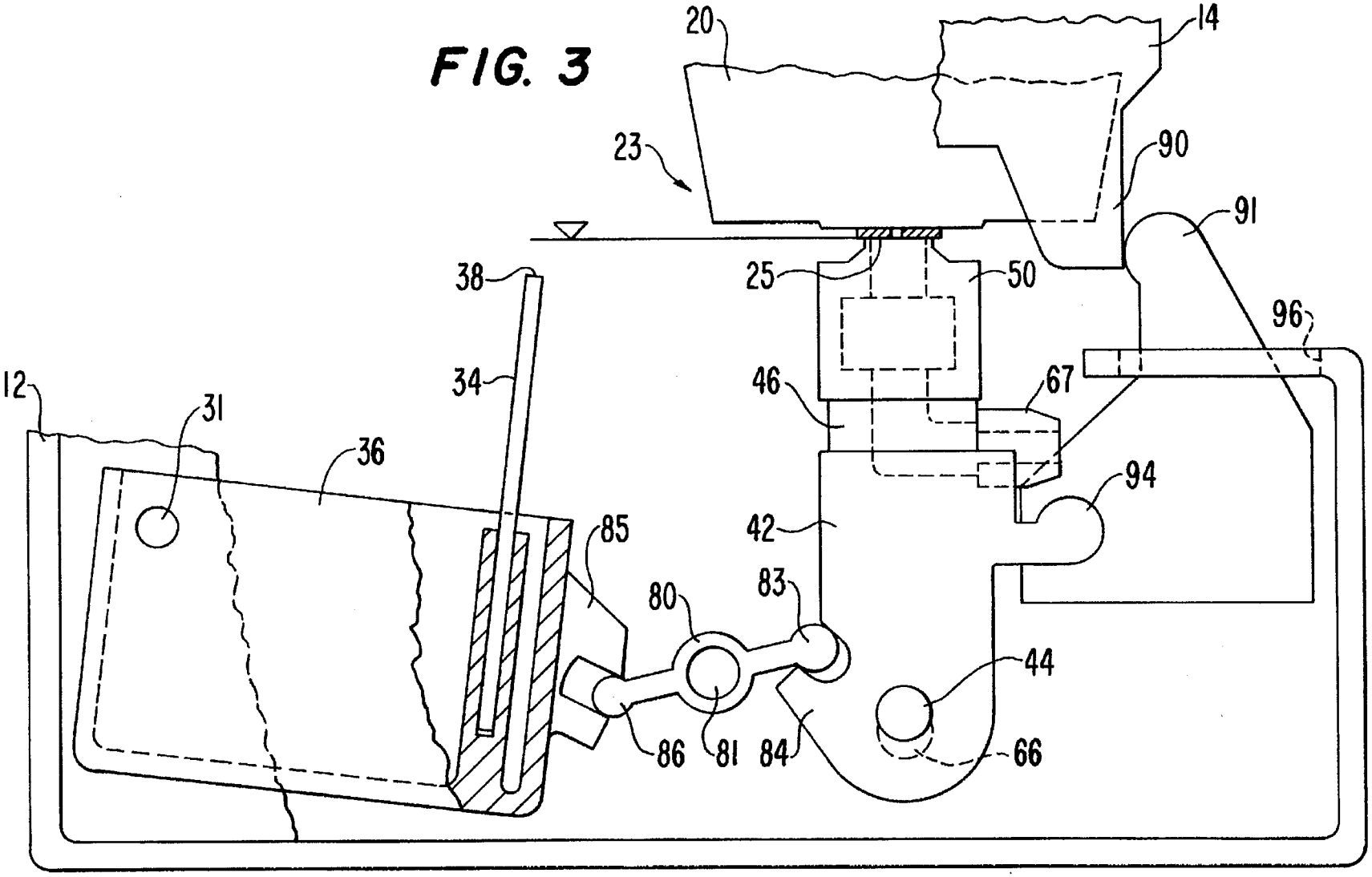
FIG. 3 shows the service station of FIG. 2 in operation.

FIG. 3 shows the position adopted by the support 42 and by the trough 36 as a result of the action of the tooth 90. As it rotates, the cap 50 presses against, without sliding over, the lower surface 25 of whichever head is fitted at that time. The cap or cover 50 is held against the surface 25 by the action of the spring 75 (FIG. 7) which allows the slide part 48 to make small movements relative to the support 42, owing to the elongated shape in section of the hole 66. In particular, the spring 75 allows the part 48 to adapt to different levels "C" and "N" of different heads.

The clockwise rotation (FIG. 2) of the support 42 about the shaft 44 causes, by means of the rocker 80, a clockwise rotation of the trough 36 and a consequent lowering of the blade 34 (FIG. 3), which moves away from the surface 25 of the heads after having removed any trace of ink from the surface 25.

When the color head 23 is kept in the service point 32, the nozzles are isolated from the external environment, in an atmosphere where the humidity is such that, owing to the low tendency of colored inks to coagulate, they remain efficient for a suitable period of time.

Since in the case of a head 22 with black ink, this ink would tend to coagulate in the nozzles when the nozzles are inactive, a certain amount of ink is aspirated from the nozzles and collected in the recess 68.

When the color head or the black head is moved away from the service point, the tooth 90 releases the lever 91. Owing to the action of the spring 97 (FIG. 2), the trough 36 rotates anticlockwise, causing the blade 34 to slide again over the surface 25 of the print heads, to again remove any traces of ink, before printing is recommenced.

It will be understood that the service station for an ink jet printer embodying the invention may be modified or have parts added to it without departing from the scope of the invention. For example, the print head may be a fixed line-type head and the unit formed by the cleaning part and restoring device may be mounted on a carriage that moves along the head.

What it is claimed is:

1. A service station for an ink jet printer, said printer including a printing support; a carriage that moves with respect to said printing support; and a print head of a first kind carried by said carriage, said print head having a plurality of nozzles for expelling drops of ink, said service station comprising:

cleaning means for cleaning said print head on said carriage when said carriage is moved to said service station, said cleaning means including a flexible blade that slides over said print head to remove residues of ink thereon, said blade being movable from a position of interference with said print head to an inactive position spaced away from said print head;

nozzle restoring and protecting means for restoring and protecting said nozzles of said print head when said carriage is located at said service station, said restoring and protecting means including a support, said support including ink collecting means for collecting the ink purged from said nozzles and supporting a cover for protecting said nozzles, said support being independently pivotable around and linearly movable along a shaft perpendicular to the motion of said print head from a rest position, in which said cover is away from said print head, to an operating position, in which said cover is in contact with said print head;

means engageable by a trigger member on said carriage during its movement towards said service station for pivoting said support from said rest position to said operating position, said support being connected to said blade by means of a rocker so as to move said blade to said inactive position spaced away from said print head simultaneously to the movement of said support to said operating position to bring said cover against said print head.

2. The service station as claimed in claim 1, in which said ink collecting means is provided with a hole of elongate section through which said shaft passes, to allow said ink collecting means to move with respect to said support.

3. The service station as claimed in claim 1, in which said cover is mounted on said ink collecting means.

4. The service station as claimed in claim 1, in which said print head of a first kind is replaceable by another print head of a second kind different from said first kind.

5. The service station as claimed in claim 4, in which said ink collecting means comprises first and second recesses, said first of said recesses collecting ink from the nozzles of said print head of said first kind, and said second of said recesses collecting ink from said other print head of said second kind.

6. A service station for an ink jet printer, said printer being capable of taking selectively a first print head of a first kind and a second print head of a second kind different from said first kind, said first print head and said second print head having a plurality of ink expelling nozzles; said service station comprising:

a nozzle restoring, protecting and cleaning device including a cleaning member for cleaning said nozzles, and ink collecting means selectively coupled to said first print head and to said second print head for collecting the ink purged from said nozzles, said ink collecting means including a support movable linearly between first and second coupling positions to couple selectively respectively with said first print head and with said second print head, said support being rotatable between a rest position and an operating position in each of said coupling positions;

setting means controlled by said ink collecting means for setting said cleaning member in a respective location adapted to a selected one of said first print head and of said second print head; wherein said setting means comprises a rocker pivotable about an axis and having a first arm connected to said cleaning member and a second arm running parallel with said axis and connected rotatably and slidingly to a fork fixed to said ink collecting means.

7. The service station as claimed in claim 6, in which said second arm comprises a guide engaged in said fork, said guide comprising two endmost portions extending parallel with said axis and engaged selectively in said fork when said ink collecting means are coupled to said first print head and to said second print head, and a third intermediate part inclined relative to said axis and engaged by said fork while said ink collecting means are moving from said first of said coupling positions to said second of said coupling positions.

8. An ink jet printer capable of taking selectively a first print head of a first kind and a second print head of a second kind different from said first kind, said print heads having nozzles for expelling drops of ink, said printer comprising:

a nozzle restoring, protecting and cleaning device including a cleaning member for cleaning said nozzles; and ink collecting means selectively couplable to said first print head and to said second print head for collecting the ink purged from said nozzles; said ink collecting means comprising a support movable linearly between first and second coupling positions to couple selectively respectively with said first print head and with said second print head, said support being rotatable between a rest position and an operating position in each of said coupling positions setting means controlled by said ink collecting means for setting said cleaning member in a respective location selectively adapted to said first print head and to said second print head;

wherein said setting means comprises a rocker pivotable about an axis and having a first arm connected to said cleaning member and a second arm running parallel with said axis and connected rotatably and slidingly to a fork fixed to said ink collecting means.

9. A printer as claimed in claim 8, including means for selectively engaging with said first print head and with said second print head when it moves to said nozzle restoring, protecting and cleaning device to selectively couple said ink collecting means to said first print head and to said second print head.

* * * * *